US006523793B1

(12) United States Patent
Higgins

(10) Patent No.: US 6,523,793 B1
(45) Date of Patent: Feb. 25, 2003

(54) INFANT FEEDING DEVICE

(76) Inventor: Yvette Higgins, 1322 Amethyst St. Apt. C, Redondo Beach, CA (US) 90277

( * ) Notice: Subject to any disclaimer, the term of this patent is extended or adjusted under 35 U.S.C. 154(b) by 0 days.

(21) Appl. No.: 10/141,284

(22) Filed: May 10, 2002

(51) Int. Cl.[7] ..... A61J 9/06
(52) U.S. Cl. ..... 248/102; 248/106
(58) Field of Search ..... 248/102, 105, 248/106, 103, 104; 5/431, 432, 433, 437, 442, 443, 465, 630, 632, 633, 655, 657

(56) References Cited

U.S. PATENT DOCUMENTS 3,905,571 A * 9/1975 Lombardo ..... 248/102
4,733,836 A * 3/1988 Barnes ..... 248/106
4,895,327 A * 1/1990 Malone et al. ..... 248/102
5,184,796 A * 2/1993 Maher ..... 248/104
5,188,320 A * 2/1993 Polka ..... 248/102
6,055,667 A * 5/2000 Jimenez ..... 2/49.1
6,098,934 A * 8/2000 Skelton ..... 248/102

* cited by examiner

*Primary Examiner*—Leslie A. Braun
*Assistant Examiner*—A. Joseph Wujciak
(74) *Attorney, Agent, or Firm*—Goldstein & Lavas

(57) ABSTRACT

An infant feeding device for hands-free feeding of an infant. The device has a knee support cushion, a body and head support cushion, and a bottle support cushion. The cushions are secured onto a mat having fastening strips. The positioning of the cushions may be adjusted to accommodate the length of the infant. The bottle support cushion is an arch that extends over the infant's body and holds a bottle in place for feeding the infant.

8 Claims, 3 Drawing Sheets

INFANT FEEDING DEVICE

BACKGROUND OF THE INVENTION

The invention relates to an infant feeding device. In particular, the invention is a series of foam cushions for supporting an infant during feeding times. The device includes a holder for a baby bottle that would enable hands-free feeding of the infant.

Infants typically need to be fed numerous times a day, especially during the first few months of life. Since the infant is not able to feed himself or herself, it is necessary for the caregiver to sit with the infant and feed him or her a bottle. This requires the caregiver to stop whatever he or she is doing at that moment in order to tend to the infant.

Thus, there exists a need for an infant feeding device which would enable hands free feeding of the infant in a safe and comfortable setting. Such a device should support the infant's body, especially his or her neck and head, while providing a bottle to the infant.

Many infant feeding devices are available that allow a caregiver to feed an infant a bottle without having to hold the infant. Most of these devices comprise bottle holder that attach to existing infant seats or the like. While such units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved infant feeding device. As such, the general purpose of the present invention, which will be described subsequently in greater detail, is to provide a new and improved infant.feeding device which has all the advantages of the prior art and none of the disadvantages.

To attain this, the present invention essentially comprises an infant feeding device for hands-free feeding of an infant. The device has a knee support cushion, a body and head support cushion, and a bottle support cushion. The cushions are secured onto a mat having fastening strips. The positioning of the cushions may be adjusted to accommodate the length of the infant. The bottle support cushion is an arch that extends over the infant's body and holds a bottle in place for feeding the infant.

It is an object of the invention to produce an infant feeding device which allows for hands-free feeding of the infant. Accordingly, the device has a bottle support that holds the bottle in place while it is being fed to the infant. Further, the bottle support is adjustable to accommodate the size of the infant being fed.

It is a further object of the invention to produce an infant feeding device that supports the entire body of the infant while feeding a bottle to an infant. Accordingly, the device has a knee support cushion and a body and head support cushion. The positioning of the cushions may be easily adjusted to accommodate the length of the infant.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 2:
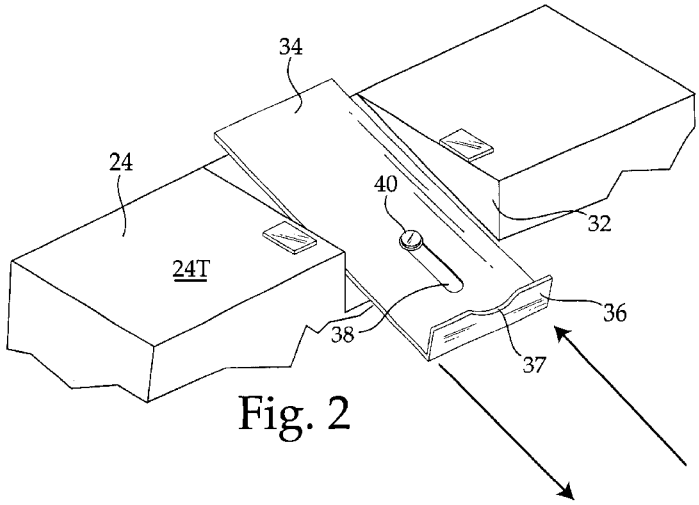
FIG. 2 is a perspective view of the top portion of the bottle support, illustrating adjustability of the bottle cradle.

10 infant feeding device
12 infant
12B infant's body
12H infant's head
12K infant's knees
14 bottle
15 bottle nipple
16 mat
16T top surface of mat
16B bottom surface of mat
16S side of mat
16P proximal end of mat
16D distal end of mat
16M middle portion of mat
20 knee support cushion
20B bottom surface of knee support cushion
22 body and head support cushion
22B bottom surface of body and head support cushion
24 bottle support cushion
24A bottle support cushion arch opening
24B bottom surface of bottle support cushion
24L leg of bottle support cushion
24T top surface of bottle support cushion
26 strip of hook and loop fasteners
26A inner strip
26B outer strip
28 inclined edge of body and head support cushion
30 cutout portion
32 inclined recess
34 plate
36 bottom lip
37 bottom lip notch
38 slot
40 button
42 strap
44 strap fastener

DETAILED DESCRIPTION OF THE PREFERRED EMBODIMENTS

Figure 1:
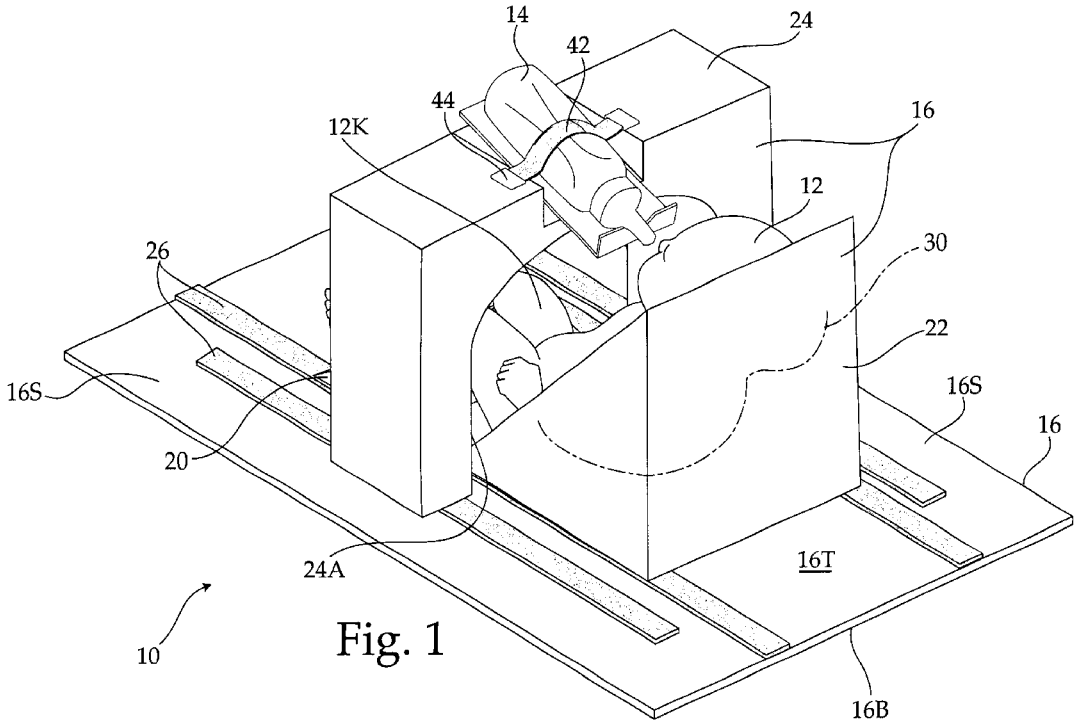
FIG. 1 is a perspective view of the infant feeding device.
Figure 3:
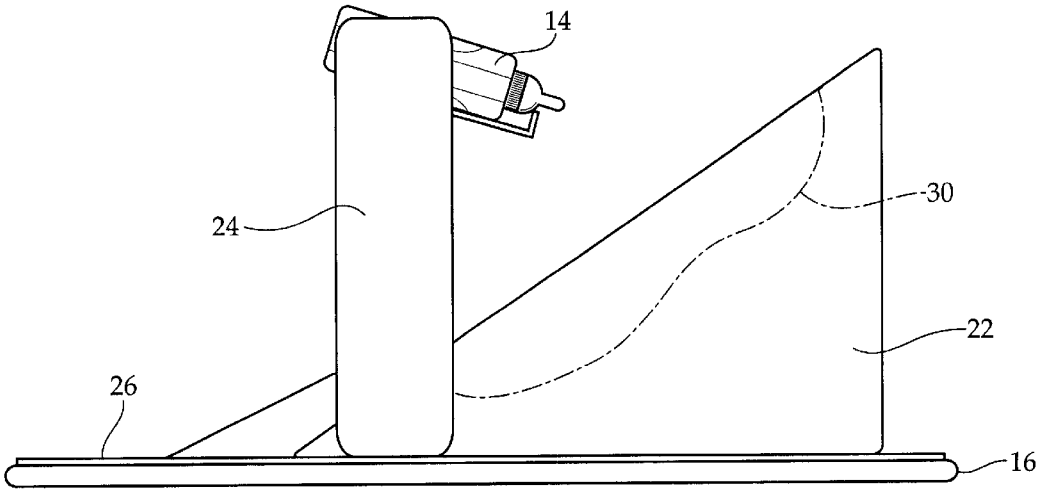
FIG. 3 is a side elevational view of the infant feeding device.

FIG. 1 illustrates an infant feeding device 10 for supporting an infant 12 during feeding times, the infant 12 having a body 12B, a head 12H, and a pair of knees 12K. The device 10 essentially comprises a mat 16 and a plurality of support cushions attached to the mat 16. The support cushions are specifically designed to support the infant's body 12B and head 12H while feeding said infant 12 with a bottle 14.

The mat 16 has a top surface 16T, a bottom surface 16B, two sides 16S, a proximal end 16P, a distal end 16D, and a middle portion 12M extending between the ends 16P, 16D. Fastening devices, namely hook and loop fastening strips 26, are positioned on the top surface 16T of the mat 16 for attaching the support cushions thereto. The strips 26 are situated in parallel pairs, including inner strips 26A and outer strips 26B, extending along both sides 16S of the mat 16. The inner strips 26A extend from the proximal end 16P of the mat 16 to the distal end 16D, while the outer strips 26B extend along the middle portion 16M of the mat 16.

The support cushions include a knee support cushion 20, a body and head support cushion 22, and a bottle support cushion 24. Each cushion 20, 22, 24 has a bottom surface 20B, 22B, 24B, said bottom surfaces 20B, 22B, 24B covered with fastening devices for securing said cushions to the mat 16 by attachment to the fastening strips 26. The knee support cushion 20 is wedge-shaped and is designed to accommodate the bend of the infant's knees 12K. The body and head support cushion 22 is also wedge-shaped, having an inclined edge 28. The inclined edge 28 has a cutout portion 30 to accommodate the body 12B and head 12H of the infant 12, as illustrated in FIG. 1.

The bottle support cushion 24 is in the form of an arch, having an arch opening 24A, having two legs 24L and a top surface 24T. Referring to FIG. 2, the top surface 24T has an inclined recess 32 wherein, when the cushion 24 is properly positioned on the mat 16, the recess 32 is slanted towards the infant's head 12H. A plate 34 positioned within the recess 32 has a bottom lip 36 with a notch 46 running therethrough. The plate 34 is designed to accommodate the bottle 14, with the nipple 15 resting within the notch 46 of the bottom lip 36. The plate 34 is selectively securable within the recess 32 by means of a button 40. A slot 38 is positioned vertically along the plate 34, towards the bottom lip 36, wherein the button 40 is selectively mateable with the slot 38, and allows the plate 34 to be vertically adjustable within the recess 32. A strap 42 having a pair of strap fasteners 44 is attached to the bottle support cushion top surface 24T, on either side of the inclined recess 32. One of the strap fasteners 44 is removable and allows said strap 42 to be stretched over the recess 32 in order to hold the bottle 14 securely in place.

Figure 4:
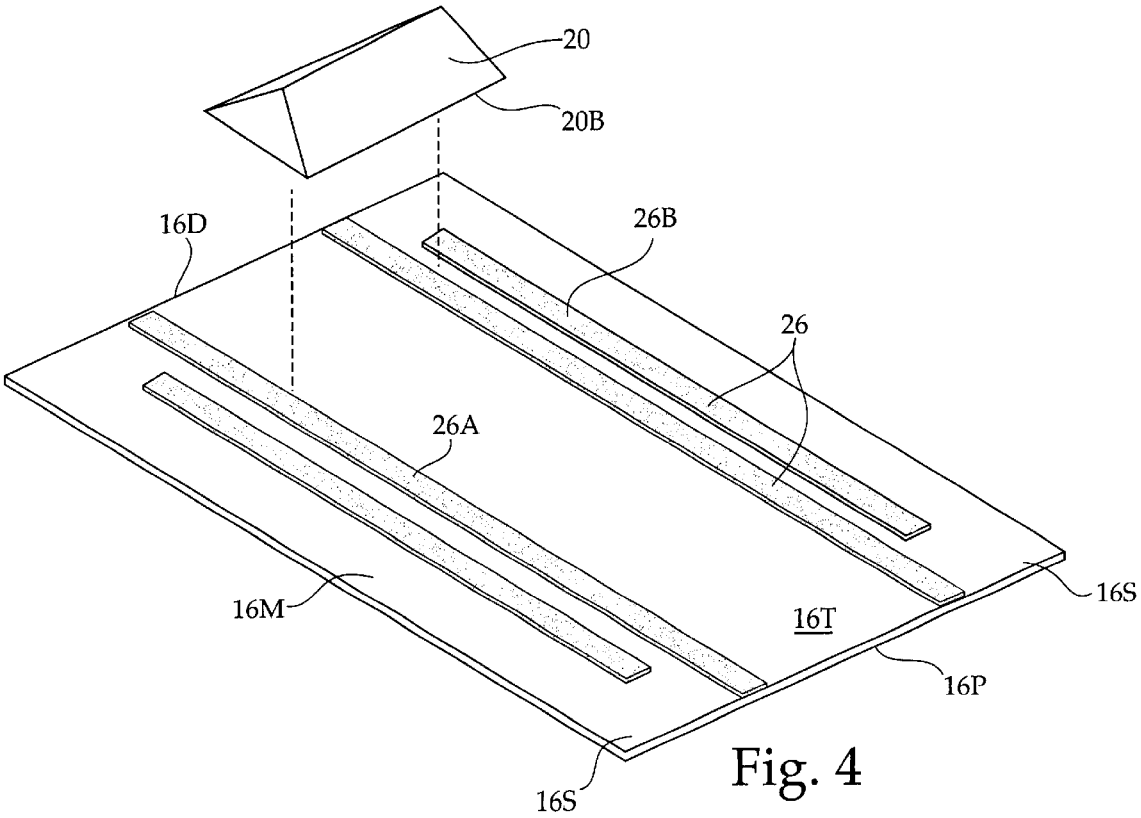
FIG. 4 is a perspective view of the mat, with the knee support cushion being attached thereto.
Figure 6:
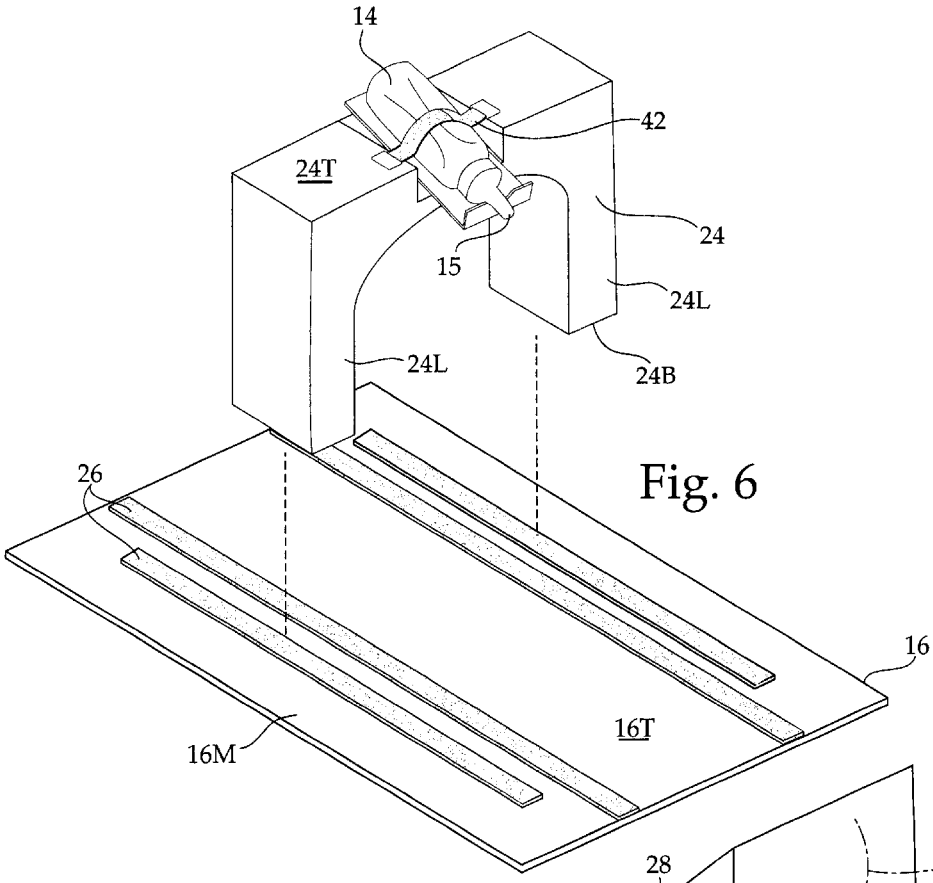
FIG. 6 is a perspective view of the mat, with the bottle support cushion being attached thereto.
Figure 5:
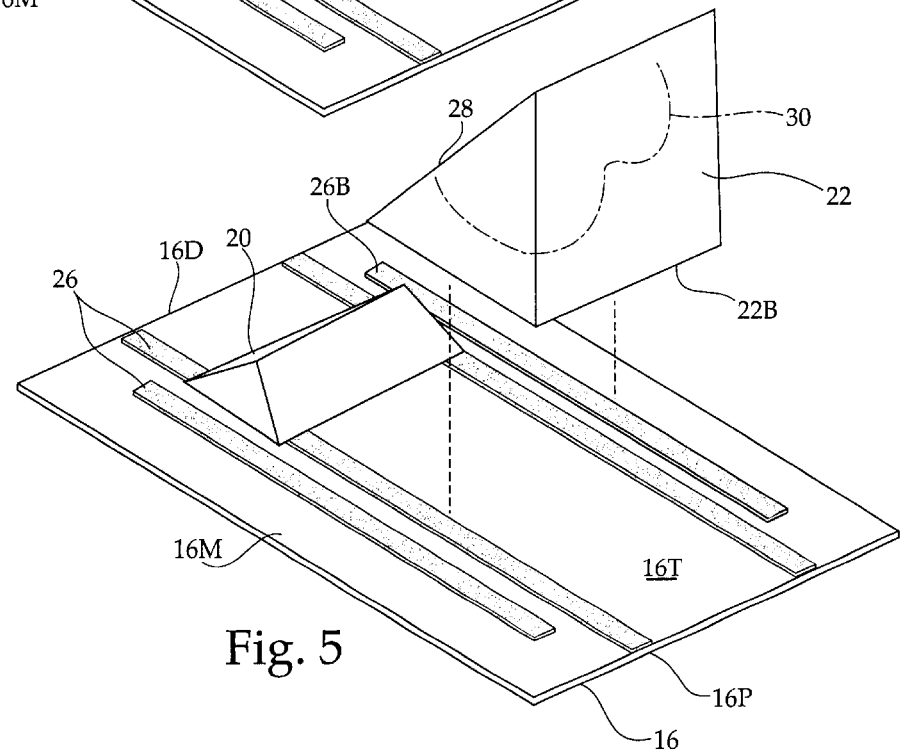
FIG. 5 is a perspective view of the mat, with the body and head support cushion being attached thereto.

In use, the mat 16 is laid out straight on a surface safe for the infant 12. The bottom surface 20B of the knee support cushion 20 is mated with the inner strips 26A on the mat 16, towards the distal end 16D, as illustrated in FIG. 4. Referring to FIG. 5, the body and head support cushion 22 is positioned on the mat 16 by bringing the bottom surface 22B of the cushion 22 into contact with the inner strips 26A towards the proximal end 16P, at a position in front of the knee support cushion 20. The infant 12 may then be placed on top of the cushions 20, 22, with his or her body 12B and head 12H positioned within the cutout portion 30 of the body and head support cushion 22, and his or her knees 12K positioned over the knee support cushion 22. The position of the cushions 20, 22 may be adjusted to accommodate the length of the infant's body 12B. Once the infant 12 is in place, the bottle support cushion 24 is placed over the infant's body 12B, with the body 12B extending through the arch opening 24A. The bottom surfaces 24B of the cushion legs 24L are mated with the outer strips 26B, along the middle portion 16M of the mat 16. The bottle 14 is then placed on the plate 34, with the nipple 15 resting in the bottom lip notch 37. The bottom lip 36 serves to prevent the bottle 14 from falling forward. The height of the bottle 14 is altered by adjusting the plate 34. The infant 12 may then be left within the device 10 with the bottle 14 available to the infant 12 for feeding.

In conclusion, herein is presented an infant feeding device. The invention is illustrated by example in the drawing figures, and throughout the written description. It should be understood that numerous variations are possible, while adhering to the inventive concept. Such variations are contemplated as being a part of the present invention.

What is claimed is:

1. An infant feeding device for hands free feeding of an infant, the infant having a head, a body, and a pair of knees, comprising:

a mat, the mat having a top surface and a plurality of parallel fastening strips positioned on the top surface; and a plurality of support cushions positioned on the mat, the support cushions including a knee support cushion, a body and head support cushion, and a bottle support cushion, each cushion having a bottom surface, said bottom surfaces having fastening devices mateable with the fastening strips on the mat, the knee support cushion being wedge-shaped, the body and head support cushion being wedge-shaped, having an inclined edge and a cutout portion along the inclined edge, the cutout portion accommodating the body and head of the infant, and the bottle support cushion being an arch having an archway.

2. The infant feeding device as recited in claim 1, wherein the bottle support cushion has a top surface, an inclined recess cut into the top surface, and a plate selectively secured within the recess, wherein the plate supports a bottle having a nipple.

3. The infant feeding device as recited in claim 2, wherein the plate of the bottle support cushion comprises a bottom lip and a bottom lip notch, the bottom lip serving to prevent the bottle from sliding off of the plate, and the bottom lip notch accommodating the bottle nipple.

4. The infant feeding device as recited in claim 3, wherein the plate of the bottle support cushion further comprises a vertical slot and a button that is selectively mateable with the slot in order to allow for vertical adjustability of the plate.

5. The infant feeding device as recited in claim 4, wherein the bottle support cushion further comprises a strap having a pair of strap fasteners positioned on the top surface, on either side of the inclined recess, said strap holding the bottle in place within the recess.

6. A method of feeding an infant with a bottle using an infant feeding device, the infant having a head, a body and a pair of knees, the bottle having a nipple, and the device having a mat and a knee support cushion, a body and head support cushion, and a bottle support cushion, the mat having a distal end, a proximal end, a middle portion, a top surface and a pair of inner fastening strips and a pair of outer fastening strips, each cushion having a bottom surface with fastening means attached thereto for mating with the fastening strips, the bottle supporting cushion having a top surface, an inclined recess, a plate within the inclined recess, the plate having a slot and a button mated with the slot, comprising the steps of:

placing the mat on a flat surface safe for the infant;

securing the support cushions to the fastening strips on the mat;

adjusting the position of the cushions on the mat according to the length of the infant;

placing the bottle on the bottle support cushion; and adjusting the height of the bottle on the bottle support cushion to be reachable by the infant.

7. The method of feeding an infant as recited in claim 6, wherein the step of securing the support cushions to the fastening strips on the mat further comprises the steps of:

attaching the knee support cushion to the inner fastening strips towards the distal end of the mat by bringing the bottom surface of the cushion into contact with the strips;

attaching the body and head support cushion to the inner fastening strips towards the proximal end of the mat by bringing the bottom surface of the cushion into contact with the strips; and attaching the bottle support cushion to the outer fastening strips in the middle portion of the mat by bringing the bottom surface of the cushion into contact with the outer fastening strips.

8. The method of feeding an infant as recited in claim 7, wherein the step of adjusting the height of the bottle on the bottle support cushion to be reachable by the infant further comprises the steps of:

loosening the button; and sliding the plate upward or downward;

tightening the button when the proper height is reached.

* * * * *